United States Patent [19]

Dumont

[11] Patent Number: 5,014,354

[45] Date of Patent: May 14, 1991

[54] ANTI-ABRASION PROTECTIVE DEVICE

[75] Inventor: Allen D. Dumont, Ann Arbor, Mich.

[73] Assignee: Mary A. Walker, Ann Arbor, Mich.

[21] Appl. No.: 545,137

[22] Filed: Jun. 26, 1990

Related U.S. Application Data

[63] Continuation of Ser. No. 261,750, Oct. 24, 1988, abandoned.

[51] Int. Cl.[5] ..... A41D 13/00; A41D 13/06

[52] U.S. Cl. ..... 2/23; 2/2; 2/22; 2/267

[58] Field of Search ..... 2/2, 267, 46, 23, 227, 2/22

[56] References Cited

U.S. PATENT DOCUMENTS

| | | | |
|---|---|---|---|
| 812,486 | 2/1906 | Dix | 2/46 X |
| 3,185,362 | 5/1965 | Wakefield | 2/46 X |
| 3,500,472 | 3/1970 | Castellani | 2/2 X |
| 3,801,984 | 4/1974 | Kanicki | 2/2 |
| 3,945,042 | 3/1976 | Lobo | 2/2 |
| 3,991,420 | 11/1976 | Savarino | 2/2 |
| 4,035,844 | 7/1977 | Atack et al. | 2/2 |
| 4,324,012 | 4/1982 | Cannaday | 2/2 |
| 4,507,801 | 4/1985 | Kavanagh et al. | 2/2 |
| 4,688,269 | 8/1987 | Maeshima | 2/2 |
| 4,700,407 | 10/1987 | Mattila | 2/267 X |
| 4,810,559 | 3/1989 | Fortier et al. | 2/23 X |

FOREIGN PATENT DOCUMENTS

| | | | |
|---|---|---|---|
| 0351147 | 1/1990 | European Pat. Off. | 2/267 |
| 2256729 | 8/1975 | France | 2/2 |

*Primary Examiner*—Peter Nerbun
*Assistant Examiner*—Gloria Hale
*Attorney, Agent, or Firm*—Harness, Dickey & Pierce

[57] ABSTRACT

An abrasion device in the form of a support member of stretch fabric and a plurality of elongated strips of cushioning material is secured to the user's body. The strips are secured to the support member and positioned against the portion of the user's body to be protected. The strips are oriented lengthwise in the direction of the anticipated relative motion between an abrading surface and the user's body. The device absorbs frictional energy and decreases heat transmission to the user's skin to prevent skin burns and abrasions.

3 Claims, 1 Drawing Sheet

ANTI-ABRASION PROTECTIVE DEVICE

This is a continuation of U.S. patent application Ser. No. 261,750, filed Oct. 24, 1988, now abandoned.

BACKGROUND AND SUMMARY OF THE INVENTION

This invention relates generally to an apparatus for protecting the body from abrasion and burn injuries and more particularly to a garment or the like adapted to position body protecting devices at desired locations on the body of the user.

A large variety of body protecting devices and garments containing integral body protecting cushions or shields have been devised to be worn by an individual to protect his body from injury during all types of sports and other physical activity. Some of these garments involve the use of permanent cushions sewn or otherwise fixed to the garment fabric. Other garments contain pockets for positioning removable cushions or shields to protect exposed areas such as knees, elbows, etc. Still other garment designs include thick, relatively stiff cushions positioned over particularly vulnerable areas of the wearer's body. All of these garments are designed to protect against serious injury to the wearer.

Conventional body protecting devices in garments are designed to protect the wearer by cushioning the impact. The devices are not designed to protect the wearer's body against the effects of sliding motion of the wearer's body against an abrading surface. On the contrary, when a wearer slides his body against an abrading surface, conventional cushions, shields or pads tend to be moved out of position thus ineffectively cushioning against the sliding impact between the wearer and the abrading surface. The result is often painful abrasions and lacerations of the skin. In addition, the sliding results in relative motion between the moving pad and the wearer's skin generating heat and causing painful skin burns.

Another disadvantage of conventional designs is that the cushions are relatively bulky. Accordingly, there is a drive to minimize the weight and bulk of any protective wearing apparel required to be worn by an individual. There is also a need for improved effectiveness of abrasion and skin burn protection in wearing apparel especially in the sport of baseball where a player may frequently slide along the ground as he approaches a base.

Another disadvantage of conventional padded or cushioned garments is that they tend to limit the freedom of movement of the wearer. Therefore there is a constant need to improve garment and shield design to maximize the freedom of movement and minimize the drag effects of the garment of the body.

It is an object of the present invention to provide a lightweight abrasion prevention device of minimum bulk.

It is another object of the invention to provide a protective device on a garment used by an individual that improves the effectiveness of the abrasion protection, minimizes frictional heat generation at the skin and maximizes the freedom of bodily movement.

One form of the abrasion prevention device according to the present invention comprises a garment of the spandex type such as Lycra having strips of cushioning material such as neoprene connected together and sewn or glued to the stretch fabric and orientated lengthwise in the direction of anticipated motion. This garment bears directly and snugly against the user's skin.

For example, in baseball, a player's undergarment in the form of trousers, according to the present invention, has vertically aligned strips of cushioning material sewn of glued to the seat of the trousers. The front of the undergarment may also have vertically aligned strips of cushioning material positioned just over the knee and horizontally aligned strips of cushioning material just below the knee portion of the undergarment trouser legs. Alternatively, the knee protection may be accomplished according to the present invention by a tube of Lycra having the strips sewn or glued thereon. The tube is then stretched to fit over the knee of the user's leg.

These strips of cushioning material elastically distort in the direction of motion between the user and the abrading surface during a slide so as to absorb energy and prevent the generation of heat on the skin thereby reducing or preventing burning and abrasion of the user's body. The strips so placed on a user's undergarment will prevent burning and abrasion of the user's knees and hips during slides taken by the player to reach a base.

The garment according to the present invention may have the strips of cushioning material positioned so as to protect any area of the user's body where sliding impact is anticipated. For example, the strips may also be positioned along the outer sides of the legs to protect the user's thighs from side sliding impact.

Other features, objects, and advantages of the present invention will become apparent from a consideration of the following description and the appended claims when taken in connection with the accompanying drawing.

DETAILED DESCRIPTION OF THE INVENTION

Figure 1:
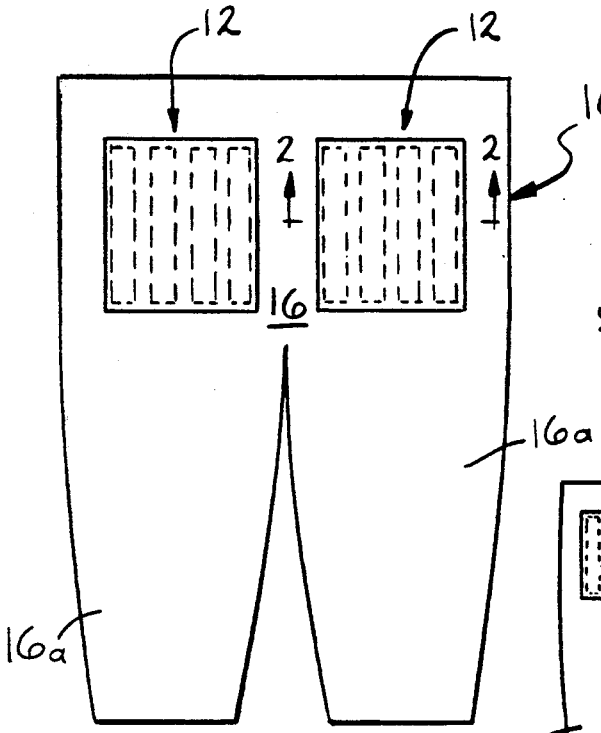
FIG. 1 is a rear elevational view of the seat of a pair of undergarment trousers illustrating the placement of the preferred form of the anti-abrading strips according to the present invention.
Figure 2:
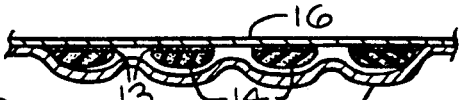
FIG. 2 is a sectional view of the strips shown in FIG. 1 taken along the line 2—2 in FIG. 1.
Figure 2A:
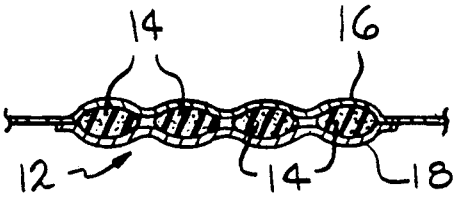
FIG. 2A is a sectional view of the strips shown in FIG. 1A as seen from the line 2A—2A in FIG. 1A.
Figure 4:
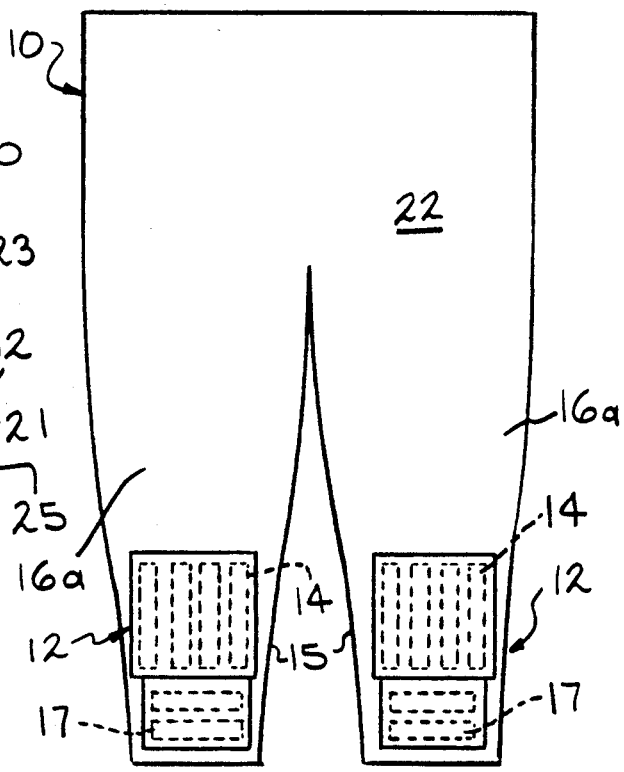
FIG. 4 is a front view of the trousers shown in FIG. 1.

With respect to the drawing, an undergarment according to the present invention, in the form of trousers 10 having a seat portion 16 and leg portions **16*a* is shown in FIGS. 1 and 4. An abrasion prevention device 12 is positioned on the trousers 10 over the buttock portions of the seat portion 16 of trousers 10 with elongated raised strips 14 positioned lengthwise of trousers 10**.

Figure 1A:
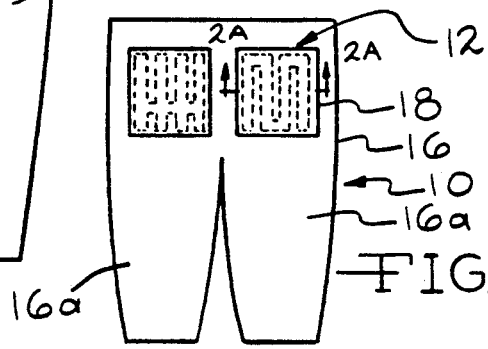
FIG. 1A is an elevational view like FIG. 1 showing a modified form of the anti-abrading strips.

Trousers 10 are made of a stretch fabric such as spandex, one form of which is marketed as Lycra, a trademark of DuPont Chemical. Postioned on seat portion 16 are a plurality of vertically positioned independent strips 14 of cushioning, elastically yieldable material such as neoprene. The strips 14 are independent of each other and are secured by adhesive 13 to the seat portion 16 so that they extend substantially parallel to the leg portions 16*a*. Alternatively, strips 14 can also be connected together such as shown in FIG. 1A. In this case the connected neoprene strips may be unsecured or also adhesively secured to seat portion 16. Strips 14 are retained in position on seat portion 16 in the forms of the invention shown in FIGS. 1 and 1A by a patch of Lycra fabric 18 loosely sewn to the portion 16 at positions extending around the strips of elongated cushioning material. Patch 18 allows some slippage of the patch material along the abrading surface to protect the neoprene strips and prevent them from being dislodged from the Lycra against the user's skin. Strips 14 are held tight adjacent the user's skin by the Lycra fabric of seat portion 16 of trousers 10.

The strips of cushioning material 14 so positioned vertically on portion 16 of trousers 10 are specifically designed to prevent abrasion on a baseball player's hips when he slides into a base. Strips 14 can, however, be positioned by a user at any location of anticipated sliding impact. For example, strips 14 may also be positioned along the sides of the trouser 10 to protect the sides of the user's legs.

During the slide, the neoprene cushioning strips 14 elastically distort in the direction of the slide absorbing energy. The Lycra material of patch 18 also distorts a limited amount. The Lycra material of seat portion 16 of trouser 10 stays in place against the user's skin. The distortion of the neoprene strips 14 minimizes the generation of frictional heat and protects the user's skin from damaging engagement with the abrading surface. The Lycra seat portion 16 staying in place prevents the generation of heat and friction between the skin and the fabric thus preventing painful skin burns.

On the front side 22 of trousers 10 over the knee area 15 of each leg 16*a* is positioned an abrasion protection device 12, according to the present invention, including a set of four vertically oriented strips 14 of cushioning material. A set of horizontally oriented strips 17 of cushioning material is also placed below the knee area 15.

The player's body position during a slide is with one knee bent. The horizontal orientation of the strips 17 approximates the direction of motion between the trousers 10 and the ground during the slide at the bent knee location.

Figure 3:
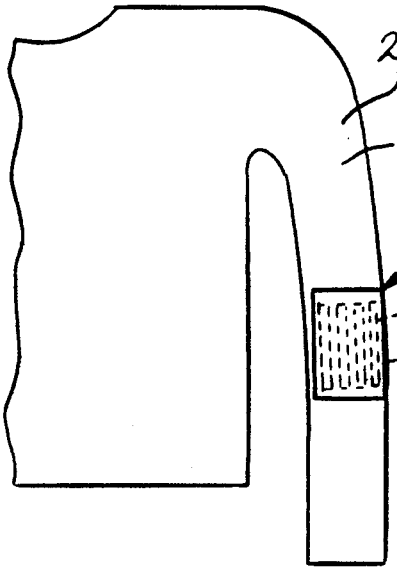
FIG. 3 is a back view of a sleeve of an undergarment jersey having the anti-abrading strips according to the present invention sewn to the elbow portion of the sleeve.

Similarly, the back of an undergarment jersey 20 made of Lycra fabric, as shown in FIG. 3 has a device 12 which includes a plurality of strips 21, like strips 14, positioned on jersey 20 in the area of the sleeve 23 at the elbow portion 25. During a slide, a fall, or other sliding impact with an abrading surface, the user's elbows will often be in a similar position in relation to the ground as described above for the user's hips. Consequently, vertically oriented strips of cushioning material as shown in FIG. 3 will elastically distort in the direction of motion to absorb the energy of friction preventing the generation of heat on the skin thus preventing burns and abrasion of the skin.

An alternative embodiment of the present invention is simply a tube shape member of spandex such as Lycra which can be stretched over a user's extremity such as an arm or leg, the tube having strips of cushioning material such as neoprene, like the strips 14, sewn thereon similar to that shown in FIGS. 1 through 4 and positioned over the knees or elbows as appropriate.

Thus the abrasion protection device 12 of this invention is a base layer, such as the seat portion 16, of stretch fabric such as Lycra secured to the user's body over the area potentially subject to abrasion and a plurality of elongated strips 14 of elastically yieldable material supported on the base layer. A plurality of strips 14 are provided and arranged parallel to each other so that they extend lengthwise in the direction of anticipated relative motion between the abrading surface and the user's body. This enables the strips 14 to provide maximum yield in the direction of the anticipated potentially abrasive movement.

The device 12 so positioned absorbs energy during sliding impact as the strips 14 elastically distort during the slide. The Lycra stays in position against the user's skin preventing heat generation against the skin thus precluding skin burns. The heat of friction generated between the abrading surface and the device 12 is absorbed by strips 14 rather than the user's body. The strips 14 thus also function to insulate the user's body from friction generated heat, decreasing the heat transmitted from the abrading surface to the user's skin.

The cushioned structure on the garment according to the present invention provides a lightweight, compact abrasion protection device which minimizes the bulk and drag on the user's body while at the same time maximizing the freedom of movement. The invention has thus been described in an illustrative manner and it is to be understood that the terminology which has been used is intended to be in the nature of words of description rather than of limitation. Obviously many modifications and variations of the present invention are possible in light of the above teachings. It is therefore to be understood that within the scope of appended claims, the invention may be practiced otherwise than as specifically described.

What is claimed is:

1. A directionally oriented abrasion prevention device in the form of a support member worn by a user for protecting a selected portion of the user's body from excessive frictional heat and abrasion caused by specific directional sliding contact with an abrading surface during physical activity, said support member comprising:

a base layer of stretch fabric positioned adjacent to the user's body, a plurality of elongated strips of a longitudinally distortable cushioning material fixably secured along their length to said base layer and covering said selected body portion, said strips being positioned substantially parallel in side-by-side relation specifically oriented on said base layer so as to longitudinally extend in the direction of purposeful and anticipated relative sliding motion between the abrading surface and the selection portion of the user's body, said strips being elastically yieldable in the direction of said purposeful relative sliding motion to absorb friction generated heat during said sliding motion, said base layer remaining substantially in position adjacent the user's body to protect the user's body from abrasion thereby preventing injury to said user, a cover layer over said elongated strips and means for attaching said cover layer to said base layer around said elongated strips, said cover layer being slidable relative said strips and said base layer to absorb a limited amount of frictional energy.

2. The device according to claim 1 wherein said support member is a pair of undergarment trousers having leg portions and a seat portion, said strips being interconnected and positioned to cover said seat portion and extending vertically toward said leg portions whereby when said user slides forwardly on said seat portion on said abrading surface, said orientation of said strips allowing said strips to yield in the direction of the sliding motion to absorb friction energy and allow said base layer to remain substantially in position to thereby prevent burns and abrasion of the user's body.

3. An abrasion prevention device in the form of a pair of undergarment trousers worn by a user for protecting a selected portion of the user's body from excessive frictional heat and abrasion caused by sliding contact with an abrading surface during physical activity, said undergarment trousers comprising:

a base layer of stretch fabric adjacent to the user's body having leg portions and a seat portion, a plurality of elongated strips of cushioning material secured to said base layer covering said selected body portion, said strips being oriented on said base layer so as to extend lengthwise in the direction of anticipated relative sliding motion between the abrading surface and the selected portion of the user's body, said strips being positioned to cover said seat portion and extending vertically toward said leg portions whereby when said user slides forwardly on said seat portion on said abrading surface, said strips being elastically yieldable in the direction of the sliding motion to absorb friction energy and thereby prevent burns and abrasion of the user's body, the front of each of said leg portions covering the knee of the user and the user's shin immediately below the knee, strips of said cushioning material being secured to said leg portions covering said knee and oriented in a direction lengthwise of the leg and strips of said cushioning material being secured to said leg portions covering said shin and oriented perpendicularly to said strips covering said knee whereby when the user slides with the lower leg knee bent, said strips covering said shin yield elastically in the direction of said sliding motion of said shin.

* * * * *